US006483408B1

(12) United States Patent
Mrenna et al.

(10) Patent No.: US 6,483,408 B1
(45) Date of Patent: Nov. 19, 2002

(54) CIRCUIT BREAKER WITH BYPASS FOR REDIRECTING HIGH TRANSIENT CURRENT AND ASSOCIATED METHOD

(75) Inventors: Stephen Albert Mrenna, Beaver, PA (US); Edward Ethber Lias, Jr., Aliquippa, PA (US); Michael Joseph Erb, Fombell, PA (US)

(73) Assignee: Eaton Corporation, Cleveland, OH (US)

( * ) Notice: Subject to any disclaimer, the term of this patent is extended or adjusted under 35 U.S.C. 154(b) by 230 days.

(21) Appl. No.: 09/689,497

(22) Filed: Oct. 12, 2000

(51) Int. Cl.[7] ..... H01H 9/30
(52) U.S. Cl. ..... 335/201; 335/6; 335/156
(58) Field of Search ..... 335/6, 156, 201

(56) References Cited

U.S. PATENT DOCUMENTS 3,849,747 A 11/1974 Mrenna et al.
4,679,016 A 7/1987 Ciarcia et al.
4,933,653 A 6/1990 Mrenna et al.
5,008,645 A 4/1991 Mrenna

*Primary Examiner*—Ramon M. Barrera
(74) *Attorney, Agent, or Firm*—Martin J. Moran

(57) ABSTRACT

A bypass conductor is provided for use in a miniature type circuit breaker. In one embodiment, the bypass conductor can include an elongated flat strap positioned in a circuit breaker housing. A first end of the bypass conductor is positioned to be adjacent to a contact arm in an open circuit position of the circuit breaker to receive current flow, especially high transient current flow. A second end of the bypass conductor is electrically coupled and/or mechanically connected to a load terminal of the circuit breaker to provide a path for current between the first and second ends. In this manner, the bypass conductor provides an alternate path for electrical current through the circuit breaker. The bi-metallic components and other sensitive elements within the circuit breaker can therefore resist the loss of useful life and other adverse operational effects caused by a high transient current event.

20 Claims, 4 Drawing Sheets

FIG.2
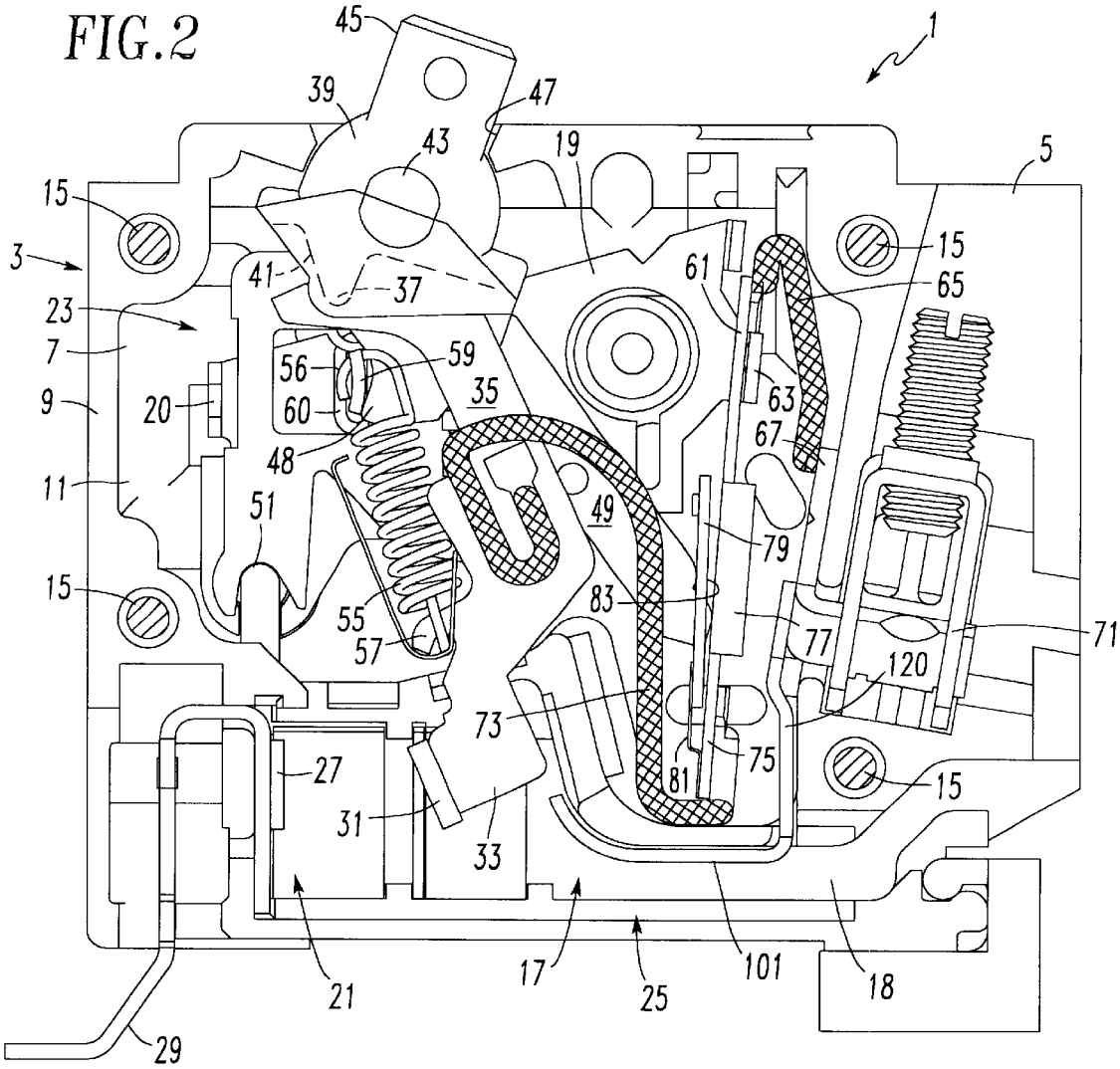
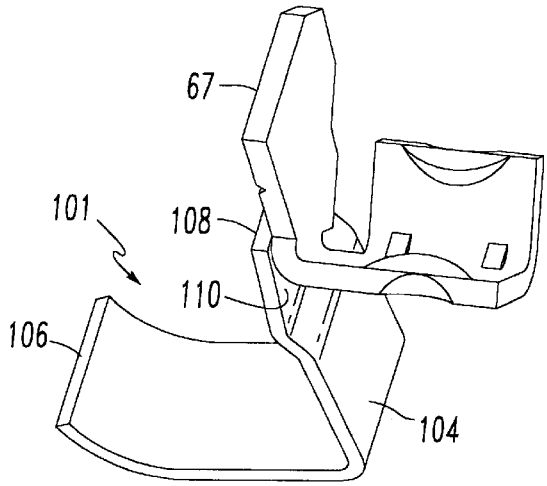
FIG.3

FIG.5
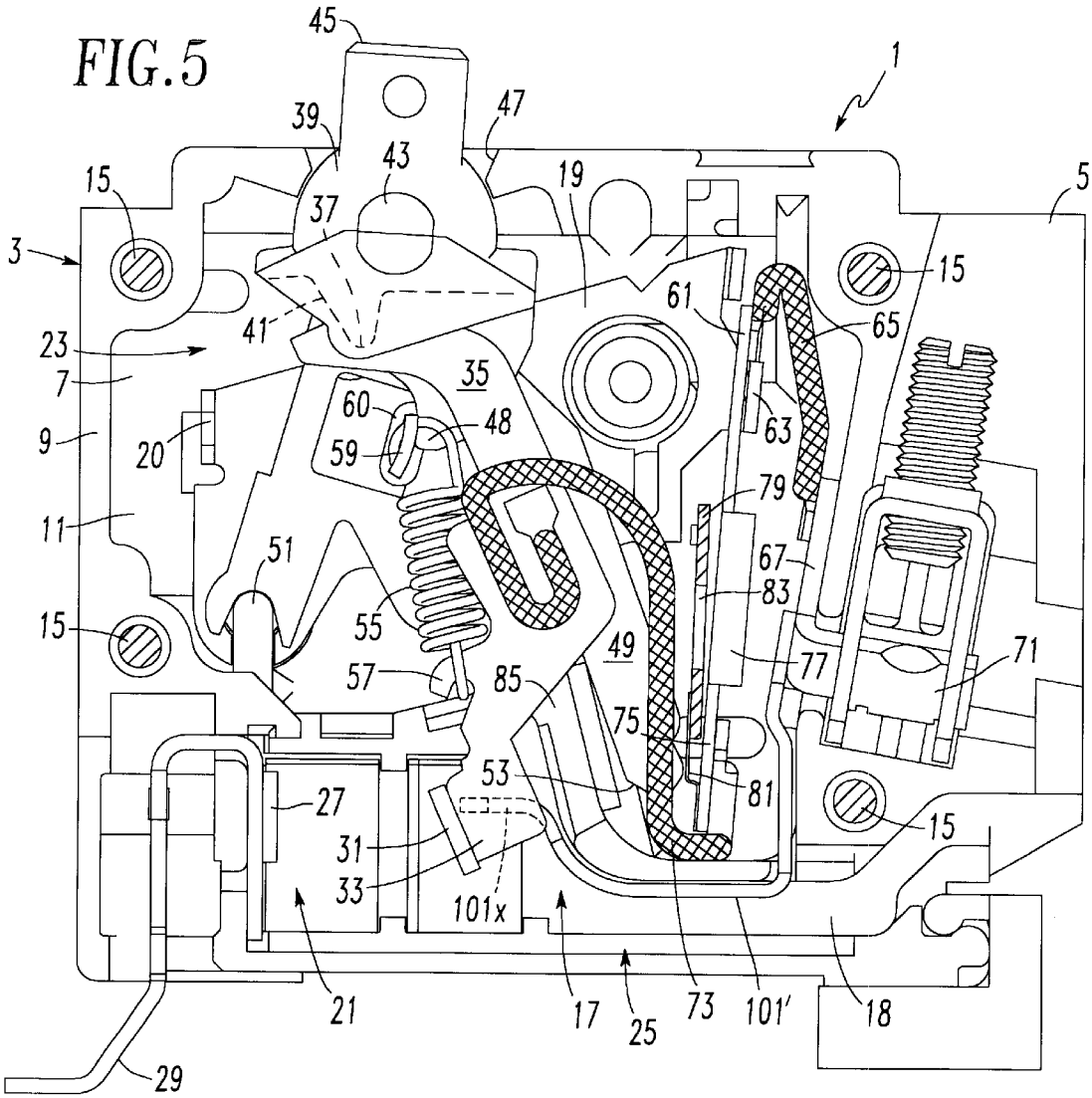
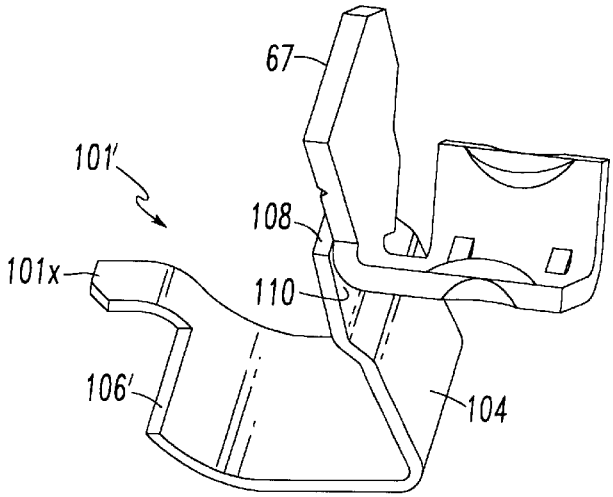
FIG.5A

CIRCUIT BREAKER WITH BYPASS FOR REDIRECTING HIGH TRANSIENT CURRENT AND ASSOCIATED METHOD

BACKGROUND OF THE INVENTION

1. Field of the Invention

The present invention relates to circuit breakers, and more particularly relates to miniature type circuit breakers including a bypass feature for directing relatively high and damaging transient currents away from sensitive components in the circuit breaker to resist damage to those components.

2. Background Information

Circuit breakers of the type having an operating mechanism and trip means, such as a thermal trip assembly and/or magnetic trip assembly, which are automatically releasable to effect tripping operations and manually resettable following tripping operations are common and generally well known in the art. Examples of such circuit breakers are disclosed in U.S. Pat. Nos. 3,849,747, 4,933,653 and 5,008,645. Such circuit breakers, commonly referred to as "miniature" circuit breakers, have been in use for many years and their design has been refined to provide an effective, reliable circuit breaker which can be easily and economically manufactured on a large scale. In addition, circuit breakers of this type are utilized in conjunction with ground fault mechanisms as well.

In operation, the bimetallic and other electrically sensitive components of the circuit breaker can be subjected to relatively high transient currents, such as when the circuit breaker is tripped to interrupt current through the circuit breaker. These high transient currents can be phase currents on the order of 9 kA or higher. In a relatively short period of time, then, these high transient currents can damage the components encased within the circuit breaker. This damage can reduce the useful life of the circuit breaker and/or adversely affect the proper functioning of the circuit breaker once the high transient event has occurred.

What is needed, therefore, is an apparatus for use in conjunction with a circuit breaker that can provide a bypass of the normal circuit path, especially for relatively high, potentially damaging transient currents. Such an apparatus is needed to resist damage to the sensitive components of the circuit breaker and thereby improve the reliability of the breaker, its useful life, and the general safe condition of the circuit breaker during its operation to interrupt current flow.

SUMMARY OF THE INVENTION

The present invention has met the above-mentioned needs by providing an apparatus for use in conjunction with a circuit breaker that permits at least a portion of a high transient current to bypass the normal current path through the circuit breaker.

The apparatus of the present invention provides a bypass conductor for use in a circuit breaker including first and second ends and a middle portion positioned in the circuit breaker housing. The first end is structured to be adjacent to a contact arm of the circuit breaker in an open circuit position of the circuit breaker to receive current flow, especially during a high transient current event. The second end of the bypass conductor is electrically coupled and mechanically connected to a load terminal in the circuit breaker to provide a path for a transient current between the first and second ends. The bypass conductor is preferably made of a metal such as copper or another suitable metal alloy or electrically conductive composite. In the invention, the bypass conductor provides an electrical path with a resistance that is reduced relative to the normal current path through the circuit breaker.

The apparatus of the present invention can further include an insulator such as glass tape, for example, positioned and applied to resist conductivity between electrically conductive elements in the circuit breaker and the bypass conductor of the present invention. The middle portion of the bypass conductor is preferably form-fitted around an insulated base portion of the circuit breaker.

A method for bypassing the sensitive bimetallic components in a circuit breaker is also provided by the present invention. The method includes providing a bypass conductor including first and second ends and a middle portion. The method also includes positioning the bypass conductor within the circuit breaker so that its first end is adjacent to the contact arm in an open position of the circuit breaker. Then, during a high transient current event, the method includes directing at least a portion of high transient current to the bypass conductor.

It is an object of the present invention to provide an alternative path for current flow through a circuit breaker.

It is a further object of the present invention to resist damage to bimetallic components among other sensitive components employed within a circuit breaker.

It is a further object of the present invention to improve the reliability and useful life of a circuit breaker.

It is a further object of the present invention to improve the electrical interruption capacity of a typical miniature circuit breaker by increasing the magnitude of current that can pass through the circuit breaker without substantially damaging its sensitive components.

These and other objects of the present invention will be more fully understood from the following description of the invention and by reference to the figures and claims appended hereto.

BRIEF DESCRIPTION OF THE DRAWINGS

A full understanding of the invention can be gained from the following description of the preferred embodiment when read in conjunction with the accompanying drawings in which:

FIG. 2 is a side view of the circuit breaker of FIG. 1 with the circuit breaker shown in the OFF or open position and including an embodiment of the bypass apparatus of the present invention;

FIG. 3 is an isometric view of the bypass apparatus shown in FIG. 2; and, FIG. 4 is a side view of the circuit breaker of FIG. 1 with the circuit breaker shown in the TRIPPED position and shown including an embodiment of the bypass apparatus of the present invention.

FIG. 5 is a side view of a circuit breaker incorporating another embodiment of the invention.

FIG. 5*a* is an isometric view of the bypass conductor which forms part of the circuit breaker of FIG. 5.

DESCRIPTION OF THE PREFERRED EMBODIMENT

Figure 1:
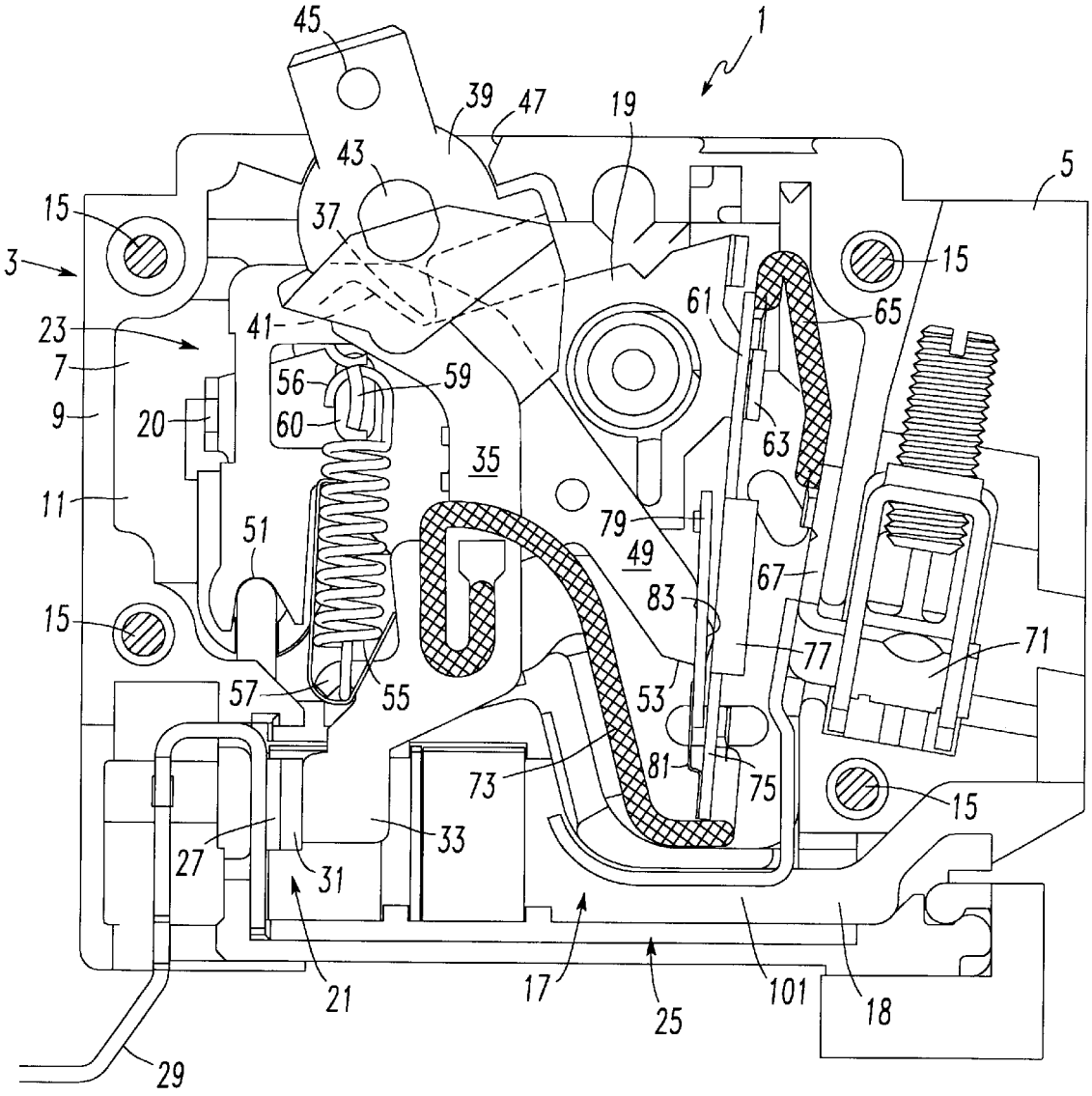
FIG. 1 is a side view of a typical circuit breaker having a bypass conductor employed in accordance with the present invention, with the cover removed and the circuit breaker shown in the ON or closed position.

Referring to the drawings, the circuit breaker 1 of the invention comprises an electrically insulating housing 3 having a molded insulating base 5 having a planar wall 7 and edge walls 9 forming a cavity 11. The housing 3 further includes a molded insulating cover (not shown) which is secured to the base 5 by four rivets 15. A circuit breaker assembly, indicated generally at 17 in FIG. 1, is supported in the cavity 11 of the housing. The circuit breaker assembly 17 includes a support plate 19 having a stop 20, a set of electrical contacts 21, a latchable operating mechanism 23 and trip assembly 25.

The set of electrical contacts 21 includes a stationary contact 27 secured to a line terminal 29, and a movable contact 31 secured to a small flange 33 on one end of a flat metallic, generally C-shaped contact arm 35 which forms part of the latchable operating mechanism 23. The contact arm 35 is provided at the upper end with a depression 37. A molded insulating operating member 39 has a molded part 41 which engages the depression 37 in the contact arm 35 to provide a driving connection between the operating member 39 and the contact arm 35. The operating member 39 is molded with a pair of pins 43 extending outwardly on opposite sides (only one shown) which fit into bearing openings (not shown) in the base 5 and the cover of the housing 3 to support the operating member 39 for pivoted movement. The operating member 39 includes a handle part 45 which extends through an opening 47 on top of the housing 3 to enable manual operation of the circuit breaker 1. The operating member 39 also includes downwardly extending portion 48 (see FIG. 4) for engaging the latchable operating mechanism 23 so as to provide for resetting the circuit breaker 1 following tripping.

The latchable operating mechanism 23 also includes a cradle 49 supported at one end for pivoted movement on a molded post part 51 of the insulating housing base 5. The other end of the cradle 49 has a latch ledge 53 which is latched by the trip assembly 25, which will be described in more detail herein. An over center tension spring 55 is connected, under tension, at one end to a projection 57 near the lower end of the contact arm 35, and at the upper end thereof to a bent over projection 59 on the cradle 49.

The trip assembly 25 comprises an elongated bimetal member 61 secured, in proximity to its upper end, to a bent over tab 63 on the support plate 19. A flexible conductor 65 is secured at one end to the upper end of the bimetal member 61 and at the other end to a conductor 67 that extends through an opening in the housing 3 and is part of a solderless terminal connector 71 that is externally accessible and supported in the housing 3 in a conventional manner. Another flexible conductor or shunt 73 is secured at one end to the free, lower end 75 of the bimetal member 61 and at the other end thereof to the contact arm 35 to electrically connect the contact arm 35 with the bimetal member 61.

The trip assembly 25 includes a thermal trip capability which responds to persistent low level overcurrents and a magnetic trip capability which responds substantially instantaneously to higher overload currents. The trip assembly 25 includes the bimetal member 61, a magnetic yoke 77 and a magnetic armature 79. The magnetic yoke 77 is a generally U-shaped member secured to the bimetal member 61 at the bight portion of the magnetic yoke 77 with the legs thereof facing the armature 79. The magnetic armature 79 is secured to a supporting spring 81 that is in turn secured at its lower end near the free end 75 of the cantilevered bimetal member 61. Thus, the armature 79 is supported on the bimetal member 61 by the spring 81. The armature 79 has a window opening 83 through which the one end of the cradle 49 extends with the latch ledge 53 on the cradle engaging the edge of the window 83 to latch the latchable operating mechanism 23 in the latched position, as shown in FIG. 1.

Figure 4:
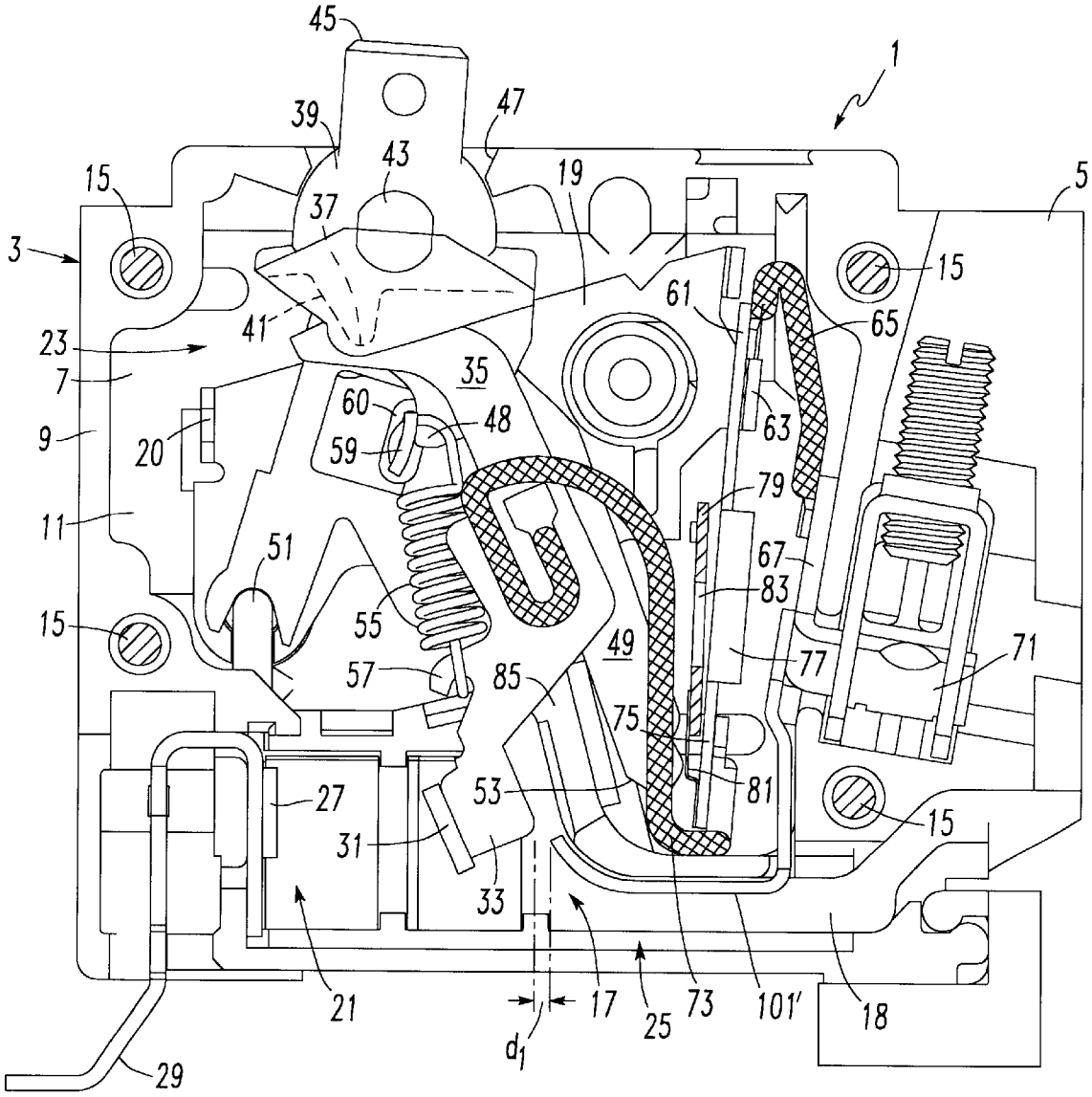

With the circuit breaker in the ON position, as shown more particularly in FIG. 1, a persistent overload current of a predetermined value causes the bimetal member 61 to become heated and deflect to the right to effect a time delayed thermal tripping operation. The armature 79, which is supported on the bimetal member 61 by means of the leaf spring 81, is carried to the right with the bimetal member to release the cradle 49. When the cradle 49 is released, the spring 55 rotates the cradle clockwise on the post 51 until this motion is arrested by the engagement of the cradle with a molded part 85 of the housing base 5. During this movement, the line of action of the spring 55 moves to the right of the point at which the contact arm 35 is pivoted on the operating member 39 to rotate the contact arm counterclockwise to snap the set of electrical contacts 21 open. FIG. 4 shows this tripped condition of the circuit breaker.

The circuit breaker 1 is magnetically tripped automatically and instantaneously in response to overload currents above a second predetermined value higher than the predetermined value for the thermal trip. Flow of overload current above this higher predetermined value through the bimetal member 61 induces magnetic flux around the bimetal. This flux is concentrated by the magnetic yoke 77 toward the armature 79. Overload current above the second predetermined value generates a magnetic force of such a strength that the armature 79 is attracted toward the magnetic yoke 77 resulting in the flexing of the spring 81 permitting the armature 79 to move to the right to release the cradle 49 and trip the circuit breaker open in the same manner as described with regard to thermal tripping operation. Following a magnetic trip operation, the circuit breaker 1 can be reset and relatched.

Following either a thermal or a magnetic trip the circuit breaker is reset by moving the handle 45 to the OFF position and then slightly beyond so that the extension 48 on the operating member engages the bent over projection 59 on the cradle 49 and rotates the cradle to relatch the latching surface 53 in the window 83 in the armature 79. The resulting OFF position is shown in FIG. 2. The circuit breaker 1 may be turned on from this position by rotating the handle counterclockwise which through the molded part 41 moves the upper end of the contact arm to the right in FIG. 2. When the contact point 37 on the upper end of the contact arm 35 crosses the line of force of the spring 55, the contacts snap closed to the ON position shown in FIG. 1. The circuit breaker 1 is returned to the OFF position manually by moving the handle clockwise as shown in FIG. 1.

Referring now to FIGS. 2 through 4, the bypass conductor 101 of the present invention is shown employed in conjunction within the housing 3 of the circuit breaker 1. In one embodiment of the present invention, the bypass conductor 101 can include an elongated flat strap having a middle portion that includes a substantially right-angled body portion 104. The bypass conductor 101 has a first end 106 adapted to be positioned adjacent to or in contact with a contact arm 35 of the circuit breaker 1 in an open circuit position or TRIPPED position of the circuit breaker 1. This permits the bypass conductor 101 to receive current, especially high transient current, flowing through the circuit breaker 1 during an event such as a circuit overload. A second end 108 of the bypass conductor 101 is electrically connected to a load terminal 71 of the circuit breaker 1 through the conductor 67 to provide a path for current between the first end 106 and the second end 108 through the bypass conductor 101.

The bypass conductor 101 is preferably composed of a metal such as copper or another suitable metal alloy or electrically conductive composite. The material from which the bypass conductor 101 is composed provides a lower resistance path relative to the conventional path for electrical current passing through the circuit breaker. In the TRIPPED position shown in FIG. 4, the contact arm 35 can come into substantial intimate contact with an end of the bypass conductor 101 or can be separated, preferably by a bypass gap distance d, of about 0 mm to 0.8 mm between the end of the bypass conductor 101 and the contact arm 35. The bypass conductor 101 can be provided with an electrical resistance that is at least equal to the electrical resistance of the thermal magnetic trip circuit in the circuit breaker 1. It can also be appreciated that the bypass conductor 101 can have an electrical resistance that is less than the electrical resistance of the thermal magnetic trip circuit. By providing a relatively lower-resistance path for current in parallel with the conventional path, the bypass conductor 101 thereby enables improved interruption of a relatively high transient electrical arc. The bypass conductor 101 therefore helps to direct current away from the thermal trip mechanism and other components of the circuit breaker 1.

In another aspect of the invention, at least a portion of the bypass conductor 101 is positioned in communication with a gas vent 18 of the circuit breaker 1. This positioning of the bypass conductor 101 in the gas vent 18 promotes commutation of a high transient current to the bypass conductor 101.

As shown more particularly in FIG. 2, a bypass insulator 120, which is preferably provided as glass tape, can be applied to the surface portion 110 of the bypass conductor 101 to resist conductivity between the bypass conductor 101 and the various electrically conductive components of the circuit breaker 1. A mechanical connection can be provided to connect and electrically couple the second end 108 of the bypass conductor 101 to the terminal connector 71 thereby completing a circuit path for redirection of a high transient current. As shown, the bypass apparatus is preferably form-fitted around the insulated base portion of the circuit breaker 1.

In operation, when the movable contact portion 31 of the contact arm 35 moves to a substantially full open circuit position, a situation favorable to arc formation is provided. A high transient current can be embodied as an arc of electrical current, for example, and this arc can be commutated to the bypass conductor 101. This commutation is due primarily to the positioning of the first end 106 of the bypass conductor 101 adjacent to or in substantial contact with the contact arm 35 during movement of the contact arm 35 to open and close the contact between the stationary contact 27 and the movable contact 31.

In normal functioning of the circuit breaker 1, for example, a high transient current having a phase magnitude of 9.2 kA might be generated from a conventional circuit rated at 14 kA and 277V. If the circuit breaker 1 takes 6 ms, for example, to operate to interrupt the circuit generating this high transient current, then the $I^2t$ energy dissipated through the circuit breaker 1 is approximately 254 $kA^2S$. Similarly, if the circuit breaker 1 takes 8 ms to function to operate the circuit, then the $I^2t$ energy dissipated through the circuit breaker 1 and its electrically conductive components is approximately 338 $kA^2S$. It is therefore desirable to redirect at least a portion of these high transient currents to the bypass conductor 101 to dissipate at least a portion of the $I^2t$ energy generated by the transient currents passing through the circuit breaker. In this manner, the bi-metallic components and other sensitive components of the circuit breaker 1 are spared at least a portion of the potentially damaging effects of the high transient current.

In another operational example of the bypass conductor 101 of the present invention, a high transient current passing through the circuit breaker 1 begins to commutate to the bypass conductor 101 after approximately 2 ms. After approximately 4 ms, in this example, substantially all of the high transient current passing through the circuit breaker 1 commutates to the bypass conductor.

In another embodiment of the invention illustrated in FIGS. 5 and 5A, the bypass conductor 101' has an extension 101*x* on the first end 106' which extends upward and then forward toward the left as viewed in these figures to overlap the flat end 33 of the contact arm 35 with the contact arm in the open or tripped positions. The tip of the extension 101*x* extends almost to the moveable contact 31 which is secured on the end of the flat contact arm. In this arrangement, there is an extended area of overlap between the bypass conductor, and the contact arm and moveable contact for supporting the secondary arc through which current is commutated from the contact arm 35 to the bypass conductor. This commutates the current to the bypass conductor sooner as the contacts 27 and 31 open thereby reducing the energy input to the bimetal and also helps in interrupting the main arc between the fixed and moveable contacts 27 and 31.

It can therefore be appreciated that the bypass conductor apparatus of the present invention provides improved protection of sensitive bimetallic components within a circuit breaker. The bypass conductor as disclosed redirects potentially damaging high transient currents along an alternate, relatively lower resistance path through the circuit breaker. The bypass conductor thereby reduces the likelihood of damage to the circuit breaker that can be caused by excessive electrical current. The bypass conductor can also enhance the useful life and proper functioning of the circuit breaker after a transient event has occurred.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. In a circuit breaker having an insulated base, a contact arm, and a thermal magnetic trip circuit in series with a load terminal, a bypass conductor comprising:

a first end structured to be adjacent to said contact arm of said circuit breaker to receive electrical current from said contact arm in an open position of said circuit breaker;

a second end structured to be connected to said load terminal of said circuit breaker to complete a path for electrical current between said first and second ends of said bypass conductor; and, a middle portion, bridging said first and second ends, structured to carry electrical current between said first and second ends.

2. The bypass conductor of claim 1, wherein said middle portion is structured to be positioned around a portion of said insulating base of said circuit breaker.

3. The bypass conductor of claim 2, wherein said bypass conductor further includes a substantially right angled body portion as said middle portion being structured to be form-fitted around said insulating base of said circuit breaker.

4. The bypass conductor of claim 1, further including said bypass conductor having an electrical resistance being at least equal to an electrical resistance of said thermal magnetic trip circuit.

5. The bypass conductor of claim 1, further including said bypass conductor having an electrical resistance being less than an electrical resistance of said thermal magnetic trip circuit.

6. The bypass conductor of claim 1, further comprising means for electrically insulating said bypass conductor.

7. The bypass conductor of claim 6, wherein said electrically insulating means includes glass tape positioned on a surface of said bypass conductor between said first and second ends of said bypass conductor.

8. The bypass conductor of claim 1, wherein said bypass conductor further includes an elongated, flat strap extending from said first end to said second end.

9. The bypass conductor of claim 1, wherein said first end of said bypass conductor is structured to be in substantially intimate contact with said contact arm in said open position of said circuit breaker.

10. The bypass conductor of claim 1, wherein said first end of said bypass conductor is structured to overlap said contact arm with said contact arm in said open position of said circuit breaker.

11. A circuit breaker comprising:

an insulated base;

a contact arm;

a load terminal;

separable contacts, one of said separable contacts being movable and the other of said separable contacts being fixed, said contact arm carrying said movable contact between a closed position and an open position; and, a bypass conductor including an elongated flat strap having a first end structured to be adjacent to said contact arm in said open position of said moveable contact to receive a high transient current, and a second end connected to said load terminal of said circuit breaker to provide a path for a high transient current between said first and second ends.

12. The circuit breaker of claim 11, wherein said bypass conductor further includes a substantially right-angled body portion positioned around a portion of said insulated base of said circuit breaker and bridging said first and second ends.

13. The circuit breaker of claim 11, further comprising means for electrically insulating said elongated flat strap.

14. The circuit breaker of claim 13, wherein said electrically insulating means includes glass tape positioned on a surface of said elongated flat strap between said first and second ends of said elongated flat strap to resist conductivity between said elongated flat strap and other electrically conductive components in said circuit breaker.

15. The circuit breaker of claim 11, wherein said second end of said elongated flat strap is connected to said load terminal by mechanical connection means.

16. The circuit breaker of claim 11 wherein said first end of said elongated flat strap is structured to overlap said contact arm in said open position of said moveable contact.

17. The circuit breaker of claim 16 wherein said contact arm is flat at a free end to which said moveable contact is fixed and said first end of said elongated flat strap has an extension which extends beside and overlaps said free end of the flat contact arm in the open position of the moveable contact.

18. A method for redirecting at least a portion of a high transient current away from bi-metallic components in a circuit breaker having a contact arm and a load terminal comprising:

a. providing a bypass conductor including first and second ends and a middle portion;

b. positioning said bypass conductor within said circuit breaker so that said first end is adjacent to said contact arm of said circuit breaker in an open position of said circuit breaker; and, c. during a high transient current event, directing at least a portion of said high transient current to said bypass conductor.

19. The method of claim 18, further including electrically insulating said bypass conductor within said circuit breaker.

20. The method of claim 18, further including connecting said second end of said bypass conductor to said load terminal.

* * * * *